US005890885A

United States Patent [19]

Eckerle

[11] Patent Number: 5,890,885

[45] Date of Patent: Apr. 6, 1999

[54] FILLING MEMBER-LESS INTERNAL-GEAR PUMP HAVING A SEALED RUNNING RING

[76] Inventor: Otto Eckerle, Am Bergwald 6, DE-76316 Malsch, Germany

[21] Appl. No.: 836,267

[22] PCT Filed: Aug. 9, 1996

[86] PCT No.: PCT/DE96/01523

§ 371 Date: Apr. 30, 1997

§ 102(e) Date: Apr. 30, 1997

[87] PCT Pub. No.: WO97/09533

PCT Pub. Date: Mar. 13, 1997

[30] Foreign Application Priority Data

Sep. 1, 1995 [GB] United Kingdom ..... 195 32 226.6

[51] Int. Cl.[6] ..... F04C 2/10

[52] U.S. Cl. ..... 418/168

[58] Field of Search ..... 418/73, 132, 166, 418/168, 171

[56] References Cited

U.S. PATENT DOCUMENTS 3,680,989 8/1972 Brundage ..... 418/171

FOREIGN PATENT DOCUMENTS 2213425 8/1974 France .
4421255 6/1995 Germany .
963736 7/1964 United Kingdom ..... 418/168

*Primary Examiner*—John J. Vrablik
*Attorney, Agent, or Firm*—Woodbridge & Associates

[57] ABSTRACT

A filling member-less internal-gear pump in which the annular gear (4) is received in a running ring (3) forming an annular gap (31), and rotates therewith. The annular gap (31) is subdivided into peripheral portions which can be sealed off relative to each other and which are delimited from each other by sealing elements (44). The sealing elements are received in receiving spaces (45) in which they are displaceable in the peripheral direction and can seal off the receiving spaces relative to each other (FIG. 5).

10 Claims, 8 Drawing Sheets

FILLING MEMBER-LESS INTERNAL-GEAR PUMP HAVING A SEALED RUNNING RING

Figure 1:
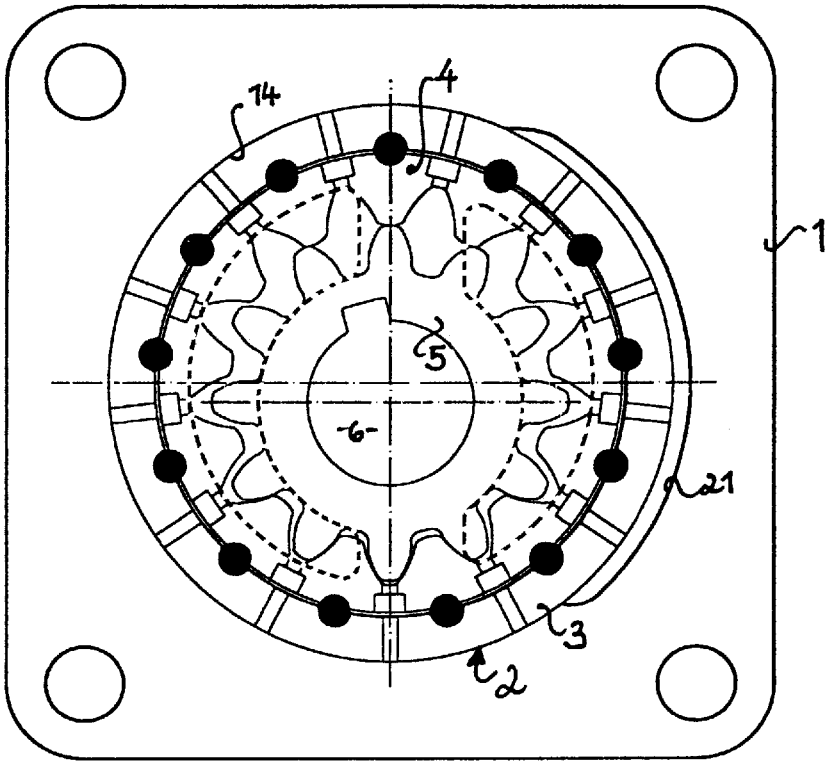

The invention concerns a filling member-less internal-gear pump having an improved design configuration for the internal-gear pump, which results in better sealing of the intermeshing teeth.

Filling member-less internal-gear pumps and motors have a tooth arrangement comprising a pinion and an annular gear, the teeth of which are sealingly in mutual contact both at the mutual engagement in gaps between the teeth and also, in approximately diametrally opposite relationship, at the oppositely disposed tooth tips, in order thereby to delimit the suction region from the pressure region. Tooth arrangements on a trochoid and a cycloid basis, but also tooth arrangements of other kinds, are considered for that purpose. As however in practice because of inevitable tolerances and because of the deformations which occur in particular at comparatively high pressures it is not possible to achieve the above-mentioned sealing contact, in particular in the region of the tooth arrangements in which the tooth tips are to bear against each other, steps must be taken to ensure such sealing contact.

In a known internal-gear pump of the above-described kind (DE-C-44 21 255) the annular gear is accommodated in a running ring, forming an annular gap therewith, and it is mounted in the casing by way of the ring. Sealing elements are radially movably accommodated in axial grooves in the peripheral surface of the annular gear, the sealing elements dividing the annular gap between the running ring and the peripheral surface of the annular gear into peripheral portions which can be sealed off relative to each other. By way of a groove provided in the casing in the region of the pressure chamber, that configuration ensures that, when the corresponding peripheral portions pass into the pressure chamber, pressure fluid is fed thereto. In that way, a pressure which is directed towards the suction chamber side is built up in the peripheral portions which are in the pressure chamber, and that force causes the tips of the teeth of the pinion and the annular gear to come to bear sealingly against each other.

As the annular gear is not mounted in the casing directly but by way of the running ring, with the formation of an annular gap therebetween, a radial force on the annular gear can be produced as between the running ring and the peripheral surface of the annular gear, in the pressure region, by virtue of the action of pressure fluid. The magnitude of that radial force can be structurally determined by the length of the groove carrying the pressure fluid and by the size and number of the peripheral portions into which the annular gap is divided. As the running ring rotates together with the annular gear, that is to say its entire outside periphery forms the bearing surface, only a small amount of wear occurs, while only very slight relative movements and therewith also no wear worth mentioning occur as between the sealing elements and the inside periphery of the running ring.

The groove which carries the pressure fluid and through which pressure fluid is fed to the annular gap when the corresponding peripheral portions pass into the region of the groove is of a part-circular configuration and at its end overlaps with the annular gap, whereby the pressure fluid can flow into same in the axial direction. On the side opposite that groove, the pump may have a discharge or relief groove of similar configuration, which is connected to the suction chamber and through which, in the peripheral portions which reach the relief groove, the annular gap is relieved again of the load of the pressure obtaining in the peripheral portions. That configuration guarantees force relationships which are precisely defined in each case by the pressure difference between the suction and the pressure sides of the internal-gear pump.

As a result of the annular gap, in operation the annular gear adopts a position which is determined solely on the basis of the equilibrium of the pressures obtaining in the tooth arrangement and in the annular gap. For that reason mechanical wear at the annular gear is very slight. Synchronous rotation of the running ring with the annular gear is ensured by entrainment elements which do not adversely affect the free mobility of the annular gear. That is achieved by recesses and projections which engage into each other in positively locking relationship and which are respectively provided on the peripheral surface of the annular gear and on the running ring.

The sealing elements which are movable in the axial grooves in the radial direction and which come to bear against the inside surface of the running ring are moved into sealing contact by spring elements and by the pressure obtaining in the pressure region. The self-suction capability of the gear pump is guaranteed or considerably improved by virtue of eccentric mounting of the running ring relative to the annular gear, partially utilising the existing annular gap. The eccentricity is so oriented that the centre line of the running ring is closer to the axis of the pinion than the axis of the annular gear. The spring elements are irregularly prestressed by virtue of that eccentricity so that as a result, even in the pressure-less condition, the tips of the teeth of the pinion and the annular gear are pressed sealingly against each other.

As the inside surface of the running ring can be formed with a very high degree of precision as a sealing surface, for example by being ground, suitable sealing elements that can be used are metal rollers which provide linear sealing contact. By virtue of that configuration, it is possible fairly accurately to determine the peripheral portions in respect of their extent in the peripheral direction, and the radial forces resulting therefrom.

The object of the present invention, based on the fundamental concept of the above-described construction of the known internal-gear pump and while retaining all advantages that it involves, is to provide a structurally simpler and functionally more effective design configuration.

In accordance with the invention, in an internal-gear pump of the kind set forth in the opening part of this specification, that object is attained by the following configuration:

A filling member-less internal-gear pump comprising a casing, an internally toothed annular gear, which rotates in the casing, a rotatably mounted pinion which meshes with the annular gear and whose teeth define a suction chamber and a pressure chamber of the tooth arrangement by engagement into gaps between the teeth of the annular gear on the one hand and sealing contact with the tips of the teeth in the annular gear in an annular gear region which is approximately diametrically opposite the engagement into the gaps between the teeth, on the other hand, and further comprising a running ring in which the annular gear is accommodated with a radial clearance forming an annular gap and rotates therewith.

By virtue of the fact that the peripheral portions of the annular gap, which are disposed in the region of the pressure chamber, are in communication by way of the radial openings through the annular gear with the pressure chamber between the tooth arrangements of the pinion and the annular gear, there is no need to provide in the casing the above-mentioned groove by which the build-up of pressure in the peripheral portions is controlled. Thus the radial openings through the annular gear which are advantageous in particular when the casing has radially directed inlet and outlet connections are utilised at the same time for applying pressure to the peripheral portions of the annular gap. Furthermore the peripherally slightly movable arrangement of the sealing elements in the receiving spaces formed by the axial grooves permits improved sealing in respect of the peripheral portions, in particular in the transitions between the suction chamber and the pressure chamber, as, because of the pronounced pressure drop obtaining there, the sealing elements are preferably urged in the peripheral direction and thereby seal off the annular gap in the pressure chamber region, relative to the suction chamber. That in turn affords the possibility of providing pre-filling slots in the region of the transitions between the pressure chamber and the suction chamber, and thereby controlling in an accelerated or decelerated manner filling or emptying of the chambers formed by the gaps between the teeth.

It is found particularly advantageous for the receiving spaces for the sealing elements to be adapted in respect of their cross-sectional shape to the cross-sectional shape of the sealing elements and for the sealing elements to be accommodated with a slight clearance therein. Accordingly the sealing elements which are preferably in the form of rollers are held in the receiving spaces which are of a correspondingly cylindrical configuration in cross-section, and they can move therein with limited radial and peripheral movements. In order to emphasise the sealing function in the peripheral direction when the sealing elements are in the form of rollers, it is possible for the transitional region of the axial grooves in the running ring and in the annular gear to be set back towards the annular gap, as a departure from a purely cylindrical cross-sectional shape, in such a way as to provide for linear sealing contact of the sealing elements.

In order to promote a rapid and uniform pressure action on the peripheral portions of the annular gap and the receiving spaces in the region of the pressure chamber, the radial openings in the annular gear desirably open into an annular groove which extends around the annular gear, in the peripheral surface of the annular gear and/or in the inside surface of the running ring.

Rotation of the running unit consisting of the pinion, the annular gear and the running ring is produced by virtue of the fact that the annular gear which is driven by the pinion is coupled to the running ring in positively locking engagement therewith. For that purpose, entrainment elements which engage into each other in positively locking relationship may be provided on the peripheral surface of the annular gear and/or on the inside surface of the running ring, in accordance with above-discussed DE-C-44 21 255. In the case of the internal-gear pump according to the present invention however it is possible to forego separate entrainment elements because the sealing elements disposed in the receiving spaces themselves produce a positively locking coupling between the annular gear and the running ring.

Figure 2:
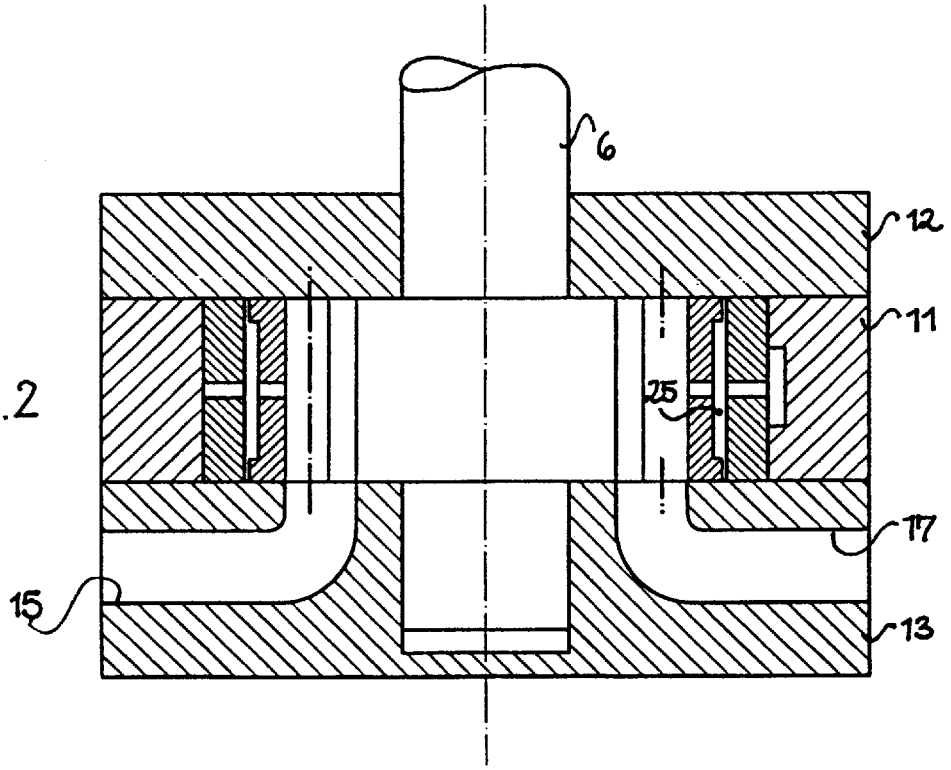
Figure 3:
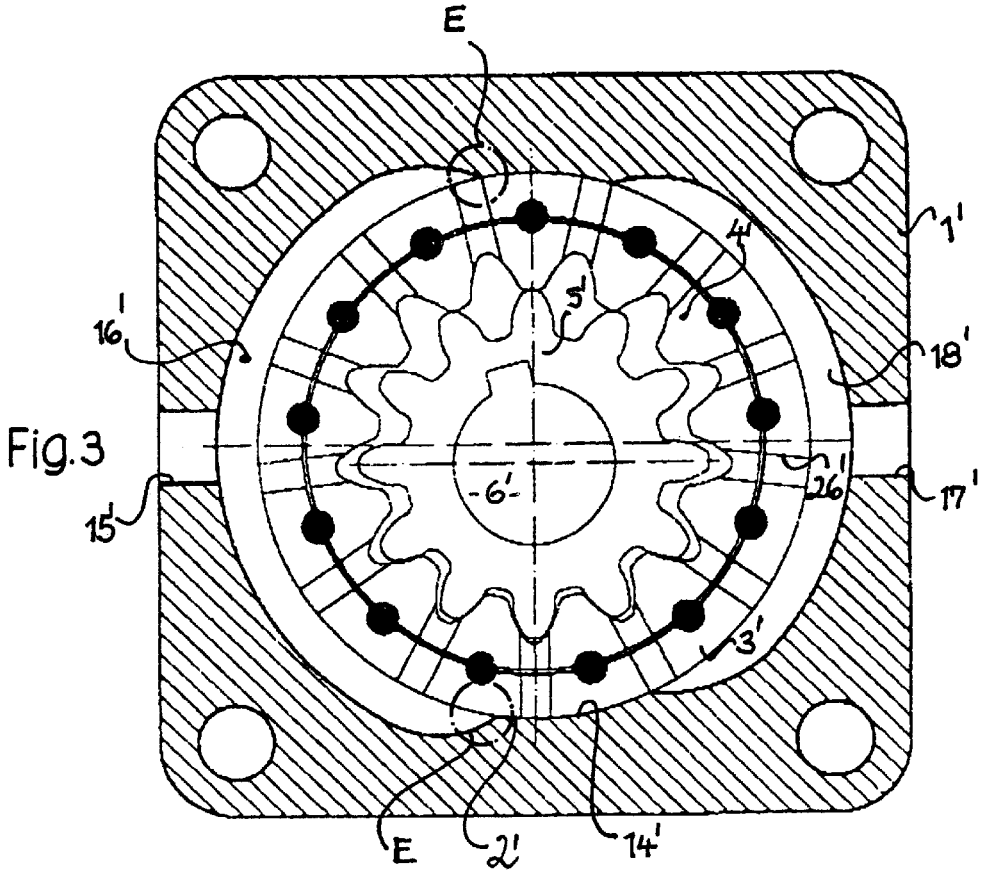
Figure 4:
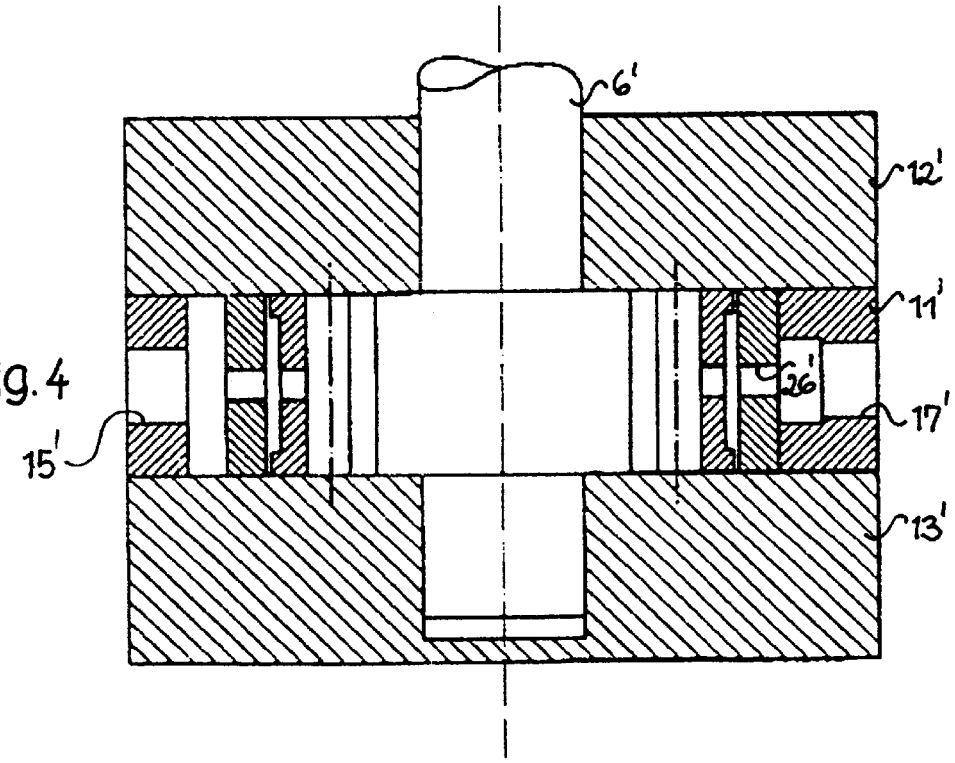
Figure 5:
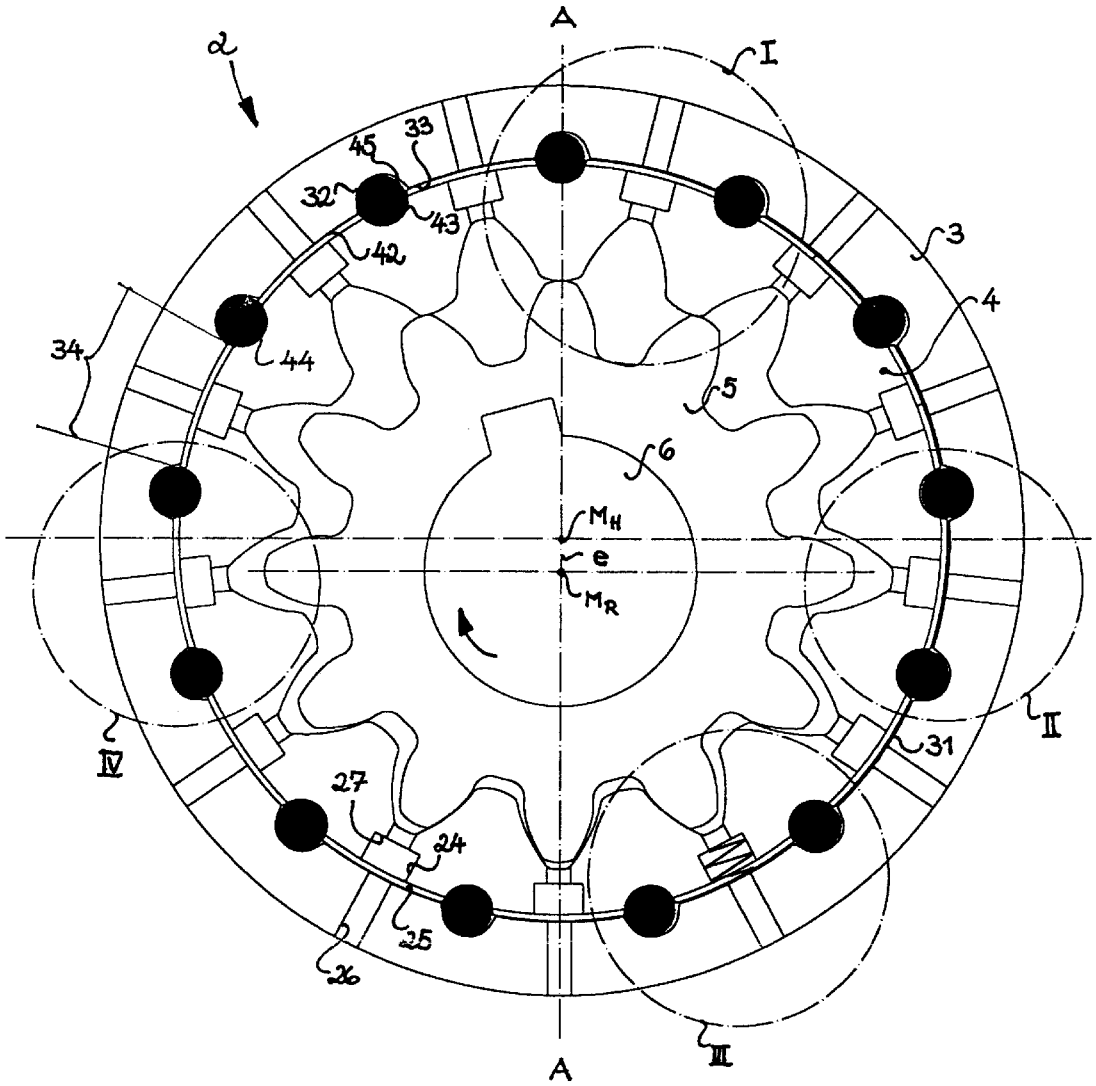
Figure 10:
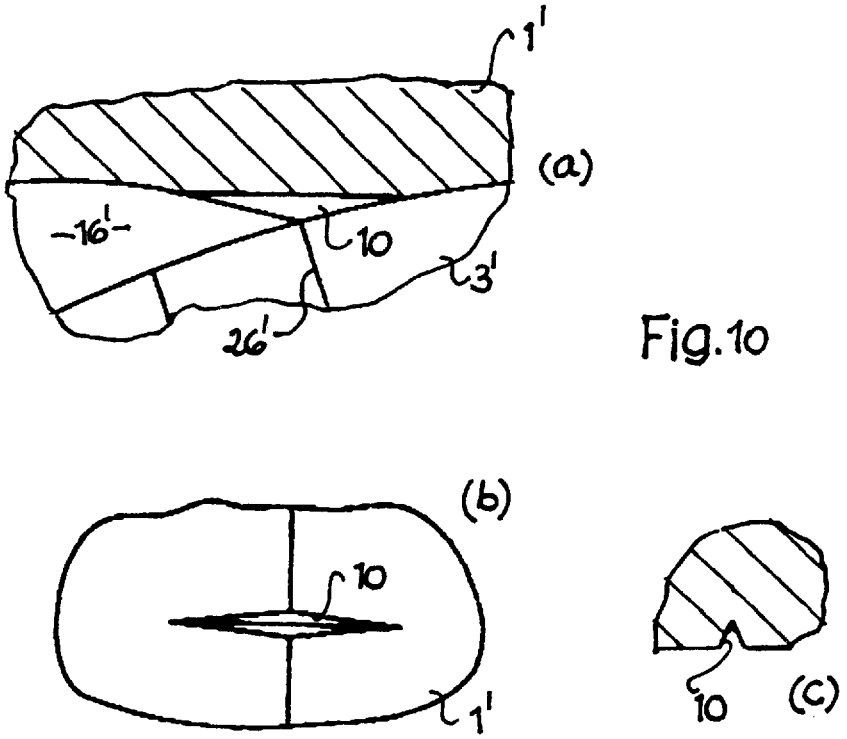
Figure 11:
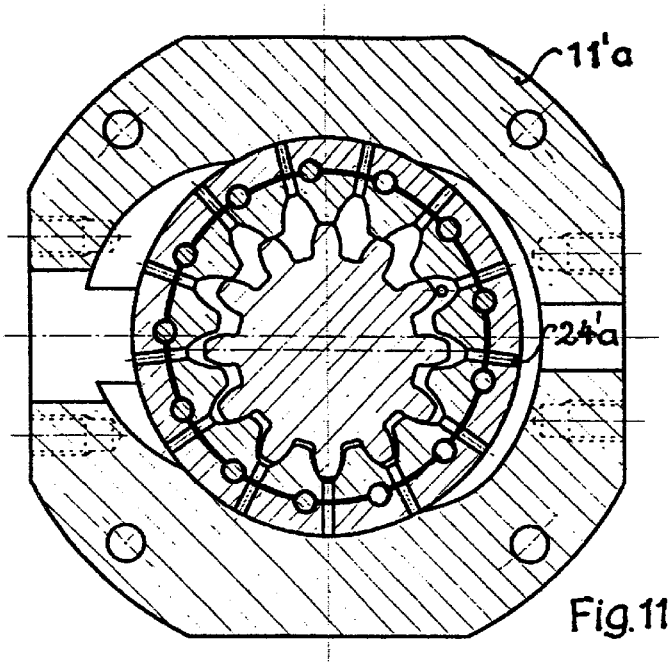
Figure 12:
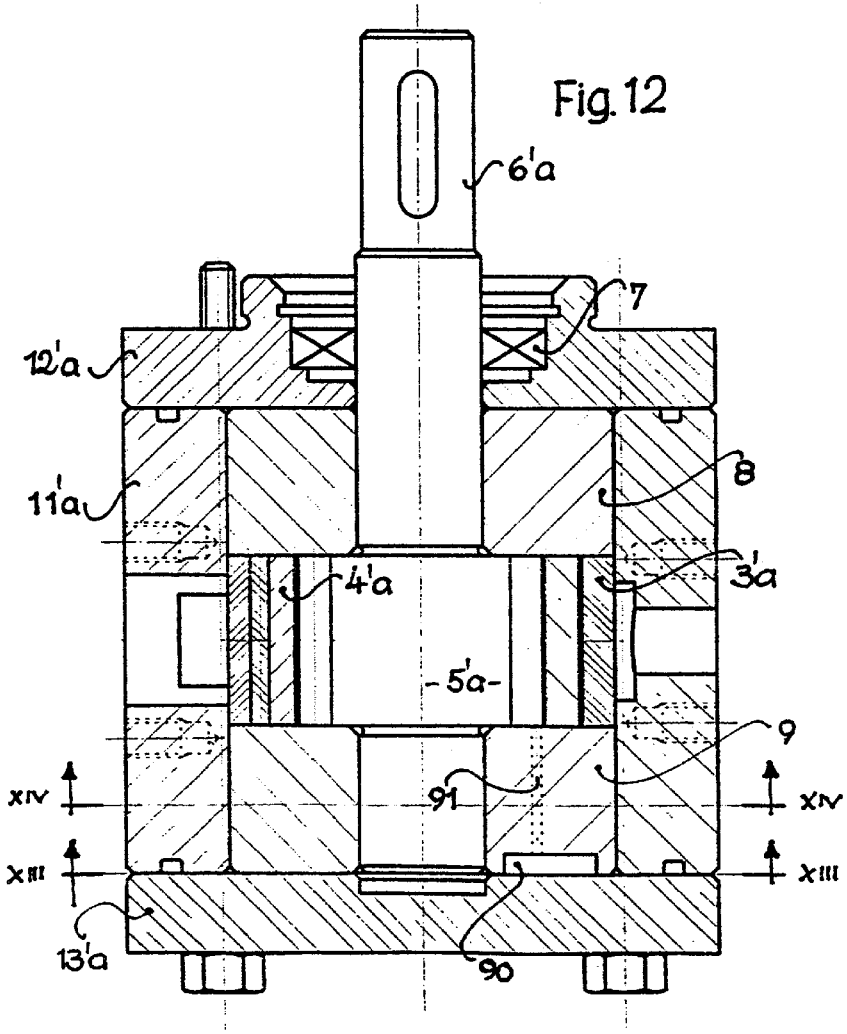
Figure 13:
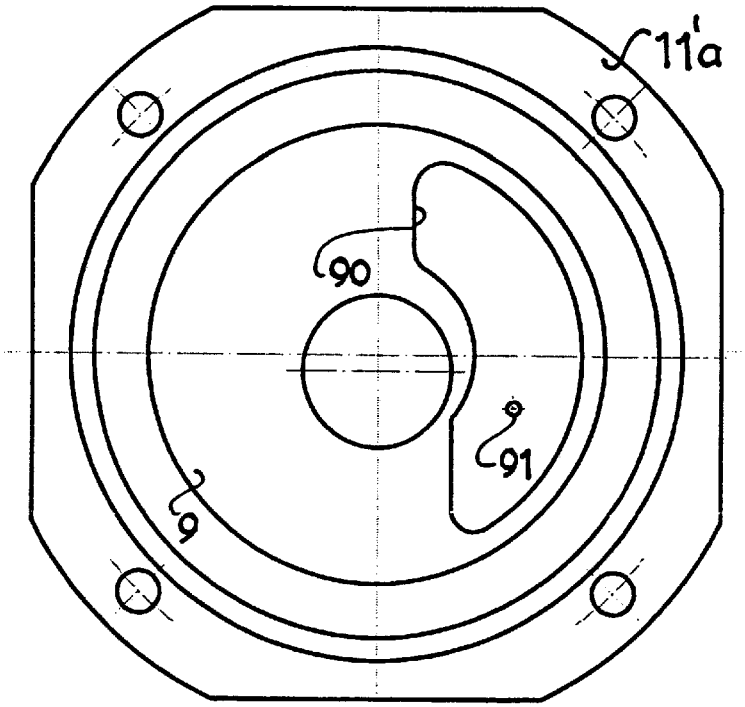
Figure 14:
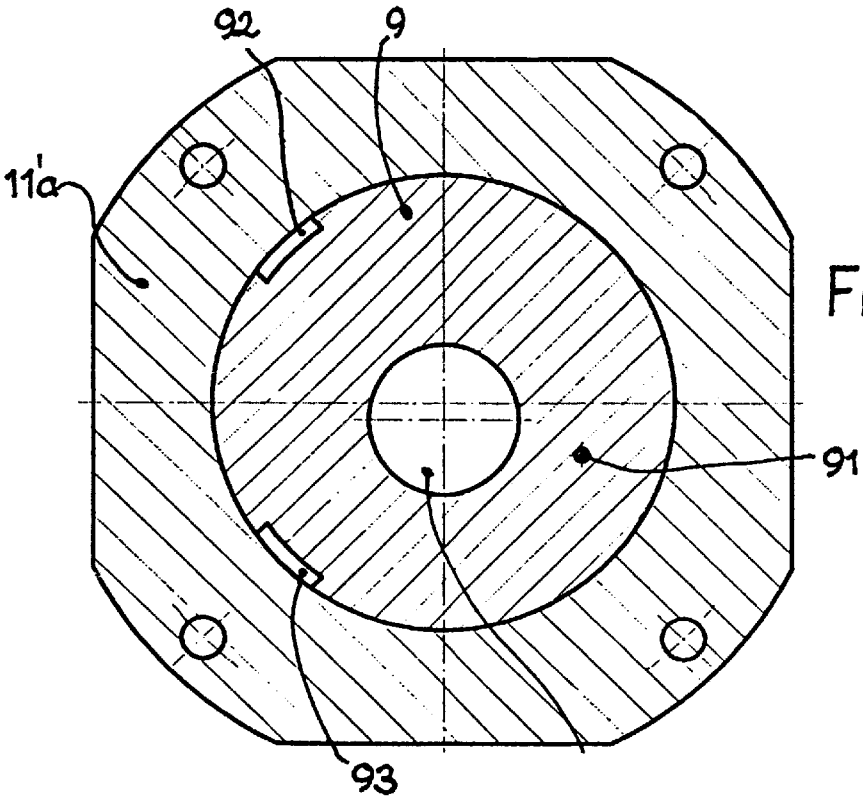

Further advantages and features of the invention will be apparent from the following description of embodiments with reference to the accompanying drawings, and from further appendant claims. In the drawings:

FIGS. 1 and 2 are views in cross-section and longitudinal section on approximately natural scale through an embodiment of the internal-gear pump with axial fluid actuation on the pressure and suction sides, FIGS. 3 and 4 are views in cross-section and longitudinal section on approximately natural scale through a second embodiment of the internal-gear pump with radial fluid actuation on the pressure and suction sides, FIG. 5 shows an end view of the running unit consisting of the pinion, the annular gear and the running ring, FIGS. 6 to 9 are views on an enlarged scale showing details from FIG. 5, more clearly emphasising the relative position of the annular gear and the running ring, as well as of sealing elements and receiving spaces, FIGS. 10*a* to 10*c*, by means of a detail from FIG. 3, show the configuration of pre-filling slots in the transitional region between the pressure and suction chambers, FIGS. 11 and 12 are views in cross-section and longitudinal section on approximately natural scale of a third embodiment of the internal-gear pump, FIG. 13 is a side view of a bearing disc with pressure portion, as viewed in the direction of the arrows XIII—XIII in FIG. 12, and FIG. 14 is a view in section taken along line XIV—XIV in FIG. 12.

The embodiments of the internal-gear pump according to the invention, as shown in FIGS. 1 to 4, each substantially comprise a casing which is generally identified by reference numeral 1 or 1', a running unit 2 or 2' which is arranged in the casing and which is composed of a running ring 3 or 3' and an annular gear 4 or 4', and a pinion 5 or 5' which is non-rotatably fixed on a respective shaft 6 or 6'. The casing 1, 1' is made up of a central portion 11 or 11' and two casing covers 12, 13 and 12', 13' respectively which are fixed to the ends of the central portion and whose inside surfaces form the mutually opposite casing walls. The central casing portion 11, 11' has a central mounting bore 14 or 14' in which the running unit 2, 2' is accommodated and supported.

In the embodiment shown in FIGS. 1 and 2 the casing cover 13 includes a suction passage 15 which, from an initially radial configuration, bends over in the axial direction and opens into the suction chamber between the tooth arrangements of the annular gear 4 and the pinion 5. In a corresponding manner, a pressure passage 17 firstly extends radially in the casing cover 13 and then opens axially into the pressure chamber between the tooth arrangements of the pinion and the annular gear.

In the embodiment shown in FIGS. 3 and 4 the connections for the flow medium are provided on the central portion 11'. There, the suction passage 15' and the pressure passage 17' extend radially throughout, and open into a suction area 16' and a pressure area 18' respectively which partially extend around the outside periphery of the running ring 3' as shown in FIG. 3.

The shaft 6, 6' is rotatably mounted by bearings (not shown) in the casing covers 12, 13 and 12', 13' respectively. As can be seen from FIG. 5 the pinion 5 and the annular gear 4 are mounted with an eccentricity e relative to each other. The eccentricity e, that is to say the spacing between the pinion axis $M_R$ and the annular gear axis $M_H$, corresponds to the theoretical tooth arrangement geometry of the pinion and the annular gear and presupposes that the tooth arrangements slide or roll against each other, without play. Without this being shown in greater detail, the running ring 3 is accommodated eccentrically relative to the annular gear 4 in the central casing portion 11 so that its axis of rotation is closer to the pinion axis $M_R$ than the annular gear axis $M_H$, by the dimension of a radial clearance relative to the peripheral surface of the annular gear 4. The mode of operation of the running unit 2, which results therefrom, corresponds to the mode of operation described in this respect in above-mentioned DE-C-44 21 255 and will be discussed again in detail hereinafter.

The annular gear 4 is arranged in the running ring 3 with a radial clearance which forms an annular gap 31. In the embodiments of FIGS. 1 to 4 the annular gap is of a width of 0.1 mm all-around, and that results in a gap of a maximum of 0.2 mm in width when the annular gear 4 is in contact against the running ring 3 at one side, as will be described in greater detail hereinafter. In its peripheral surface 42 the annular gear 4 has axial grooves 43 which are approximately semicircular in cross-section and opposite which axial grooves 32 of a corresponding configuration are provided in the inside surface 33 of the running ring 3. The mutually oppositely disposed axial grooves 32, 43 provide receiving spaces 45 which each accommodate a respective sealing roller 44 of circular cross-section (see FIG. 6). In the embodiment described here the sealing rollers 44 preferably comprise a high-strength plastic material which is resistant at up to temperatures of 180° C. The dimensions of the receiving spaces 45 and the sealing rollers 44 are so selected that the sealing rollers 44 are slightly displaceable both radially and also in the peripheral direction, in which respect the radial clearance only has to be sufficient to ensure unimpeded displacement of the sealing rollers 44 in both peripheral directions. This does not exclude the sealing rollers 44 bearing lightly against the bottoms of the axial grooves 32, 43 in such a way that the annular gear 4 is partially also supported on the running ring 3 by way of the sealing rollers 44. As can be more clearly seen from FIGS. 6 to 9, the transitional region of the axial grooves 32 and 43 is bevelled towards the annular gap 31, insofar as the configuration deviates from a purely cylindrical cross-sectional shape and insofar as it increases the width of each respective groove, in order to provide for reliable sealing linear contact between the sealing rollers 44 and the sides of the two axial grooves.

The annular gear 4 also has radial through-openings 24 which extend from the bottoms of the gaps between its teeth and which open into an annular groove 25 (see FIG. 2) in the peripheral surface of the annular gear 4. The annular groove 25 which is disposed around the annular gear 4 and whose cross-section can be seen from FIG. 2 passes through the axial grooves 43 and serves to reliably fill the peripheral portions 34 of the annular gap 31, which are between the axial grooves 32, 43, and to supply flow medium to the receiving spaces 45.

Coaxially with the radial openings 24 the running ring 3 also has radial through-openings 26 which, in the embodiment of FIGS. 1 and 2 open on the pressure side into a recess 21 in the casing (see FIG. 1) which forms a hydrostatic bearing for the running unit 2. In the embodiment shown in FIGS. 3 and 4 the corresponding openings 26' serve to convey the flow medium under pressure towards the pressure passage 17' and for that reason they are of larger cross-section than in the embodiment of FIGS. 1 and 2.

The tooth arrangements of the annular gear 4 and the pinion 5 in the illustrated embodiment are involute tooth arrangements, that is to say tooth arrangements in which the contour of the tooth flanks is formed by involute curves while the contour of the tooth surfaces in the tip and root regions is formed by circular arcs. The number of teeth and the geometry of the tooth arrangements are so selected that, in the region of the separation line A—A (see FIG. 5) the teeth of the pinion 5 fully engage into the gaps between the teeth of the hollow gear 4 or, diametrally opposite same, they have come entirely out of the gaps between the teeth of the annular gear 4 and the tooth tips are supported sealingly against each other. So as to ensure smooth shock-free running engagement as between the pinion 5 and the annular gear 4, it is desirable to round off the tooth tips, that is to say remove the edges between the addendum circle and the tooth flanks. It may be particularly advantageous in that respect for that removal to be asymmetrical with respect to the tooth centre line, that is to say, to adopt a larger rounding radius on the entry side than on the exit side.

For the purposes of control and fine matching of the force which acts on the annular gear 4, 4' from the pressure side and which occurs as a resultant of the forces in the individual peripheral portions 34 of the annular gap 31, in the region of the pressure chamber, the embodiment shown in FIGS. 3 and 4 for example has pre-filling slots at the transitions, as identified by E, of the suction area 16' into the casing portions which bear sealingly against the outside periphery of the running ring 3'. The configuration and arrangement of a corresponding pre-filling slot 10 at the exit transition E of the suction area 16' can be seen in FIG. 10. It will be seen therefrom that the pre-filling slot 10 extends a certain distance out of the suction area 16' into the sealing casing region so that, when the running ring 3' passes into that region, filling of the corresponding gaps between the teeth of the annular gear 4' still occurs to a certain extent, through the radial opening 26'. That also influences the pressure drop at the beginning of the pressure chamber. That influence depends on the number of pre-filling slots 10 and the cross-sectional size thereof. The mode of operation of the control and pre-filling slots of that kind is relevantly known and therefore does not need to be described in greater detail here.

The mode of operation of the internal-gear pump in accordance with the described embodiments is explained hereinafter with reference to the running unit of FIG. 5, on the basis of FIGS. 6 to 9. In that respect FIGS. 6 to 9 show positions I to IV circled in dash-dotted lines in FIG. 5.

Figure 6:
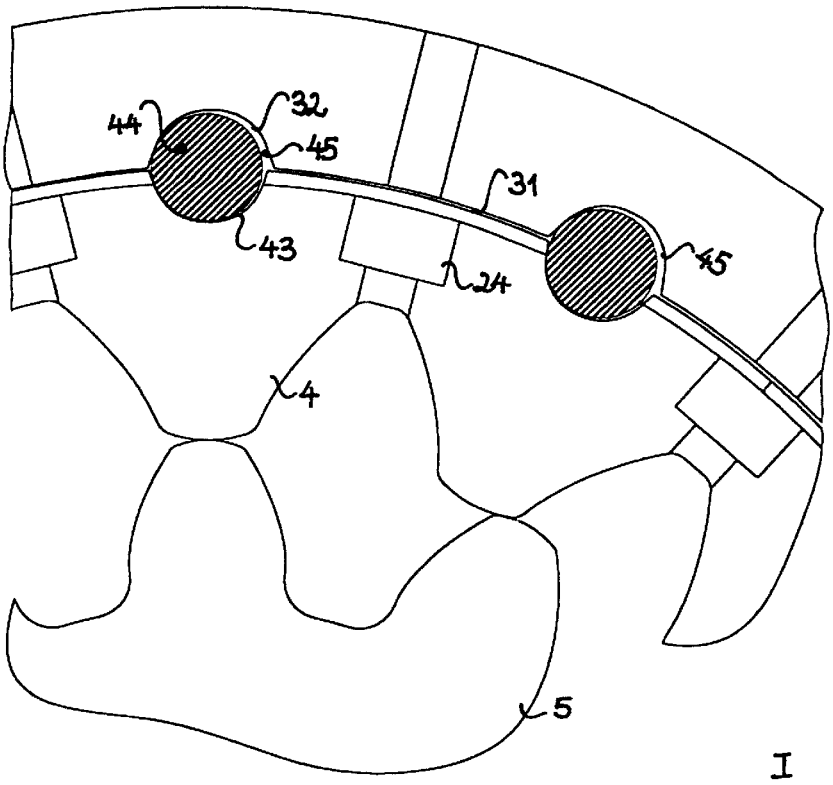
Figure 7:
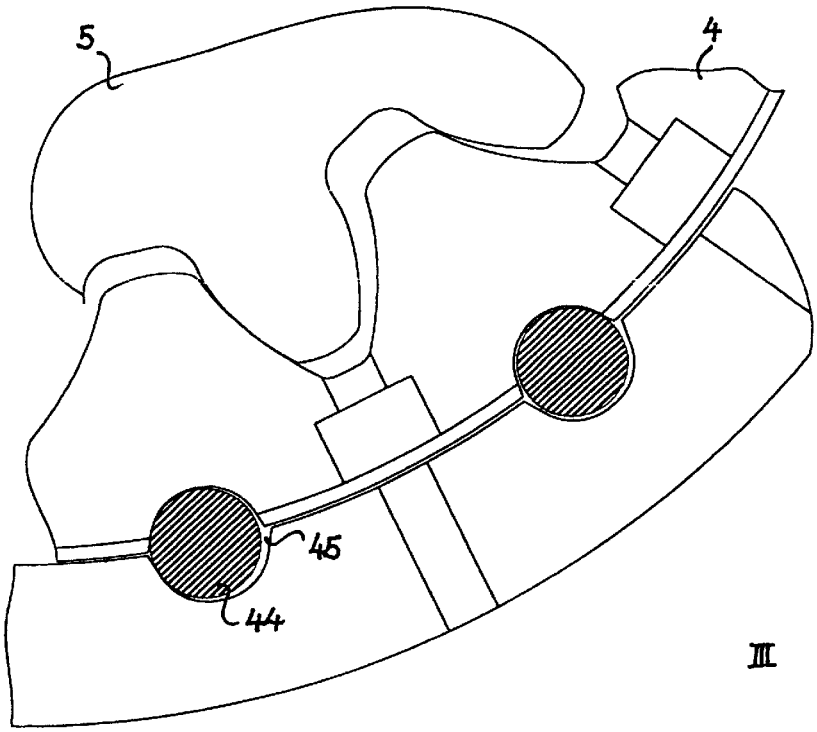
Figure 8:
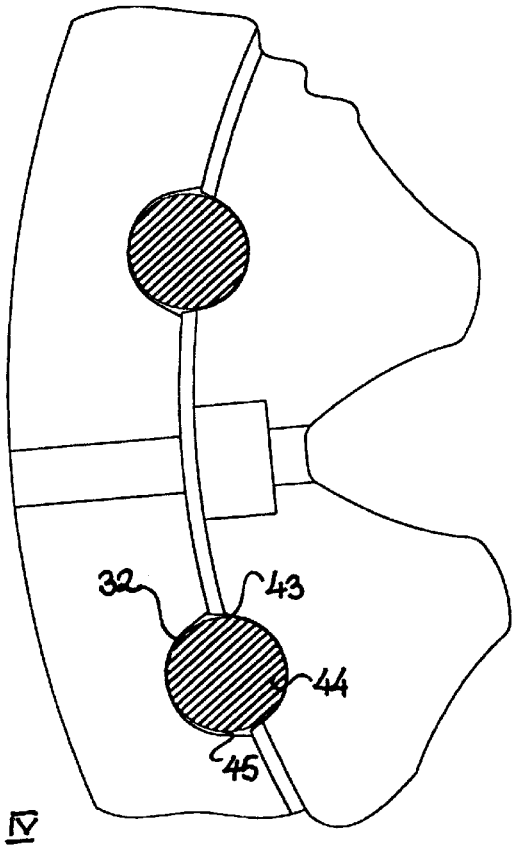
Figure 9:
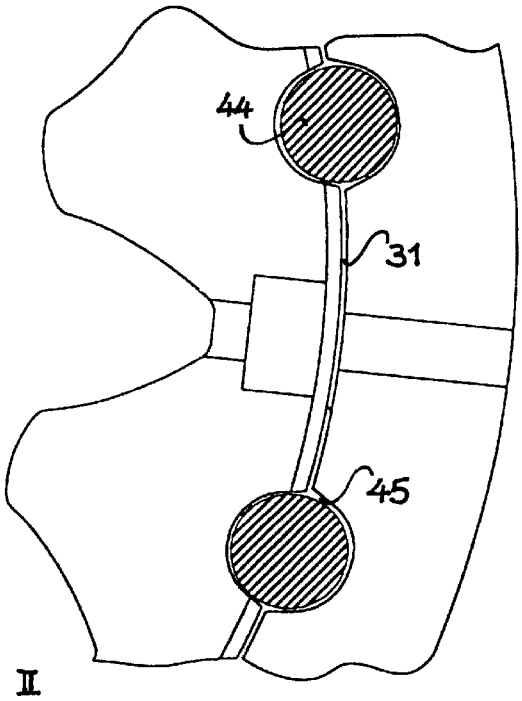

On the suction side (to the left of the separation line A—A in FIG. 5) the suction chamber between the tooth arrangements of the annular gear 4 and the pinion 5 and thus also the part, which is to be found there, of the annular gap 31 between the running ring 3 and the annular gear 4, is subjected to the suction pressure of the flow medium. As pressure equality substantially prevails in that region in the transitional portions 34 of the annular gap 31, the sealing rollers 44 lie in position IV (FIG. 8) approximately centrally in the associated axial grooves 32 and 43 respectively, that is to say in the receiving spaces 45 formed thereby. When the running unit 2 rotates in the direction of rotation indicated by the arrow (FIG. 5) the receiving spaces 45 pass out of the suction chamber, beyond the separation line A—A, into position I (FIG. 6). In that position the tips of the teeth of the annular gear 4 bear sealingly against the tips of the teeth of the pinion 5 since—as described hereinafter—the annular gear is urged in the corresponding direction. When the arrangement makes the transition from the suction chamber into the pressure chamber, that is to say, on passing across the separation line A—A, an increasing pressure is built up in the gaps between the teeth of the annular gear 4, by virtue of a reduction in the volumes of the gaps between the teeth. Corresponding pressure is transmitted by way of the radial openings 24 into the associated peripheral portions 34 of the annular gap 31 and into the adjoining receiving spaces 45. As different pressures still prevail in the gaps between the teeth in the vicinity of the transition between the suction chamber and the pressure chamber, at that location by virtue of the corresponding pressure drop between the peripheral portions 34 the sealing rollers 44 are urged in the peripheral direction, in opposite relationship to the direction of movement (towards the left in FIG. 6) and are caused to bear sealingly against the sides of the axial grooves 32 and 43. The annular groove 25 of the annular gear 4 is also closed thereby. Upon further rotary movement the pressure drop is substantially equalised in the pressure chamber between the peripheral portions 34 so that, in position II (FIG. 9), the sealing rollers 44 again assume a substantially central position in their receiving spaces 45. On approaching the transition from the pressure chamber to the suction chamber, that is to say when approaching the separation line A—A, a pressure drop is again produced as between the peripheral portions 34, which pressure drop is possibly determined by a control slot 10 provided at the corresponding location E (FIG. 3). Consequently, in position II (FIG. 7), the sealing roller 44 is again displaced in its receiving space 45 in the peripheral direction, this time in the direction of travel, and is pressed sealingly against the sides of the axial grooves. That determines the number of peripheral portions 34 which are under a higher pressure, as between the positions I and III, and consequently determines the pressure force acting in that region on the annular gear 4.

When the arrangement again passes across the separation line A—A and when the radial openings 24 and 26 pass into the suction chamber, the peripheral portions 34 and therewith also the receiving spaces 45 are fully relieved of load in respect of suction pressure.

As the sealing rollers 44 in the receiving spaces 45 act at the same time as entrainment elements by which the driven annular gear 4 entrains the running ring 3, in the pressureless condition in the peripheral portions 34 the sealing rollers 44 are caused to bear against the sides of the respective axial grooves 43, which trail in the direction of movement, and against the sides of the axial grooves 32, which lead in the direction of travel. However, that condition is eliminated by the above-described pressure conditions in the individual peripheral portions 34 in the region of the pressure chamber, equalisation of pressure being produced by the displacement of the sealing rollers 44 in different directions at the entrance into the pressure chamber and at the exit therefrom.

As a result of the annular gap 31 between the running ring 3 and the annular gear 4 the annular gear 4 deflects under the higher pressure towards the suction chamber so that the maximum gap width of for example 0.2 mm occurs in position II (FIG. 9) while, opposite thereto, the annular gap is completely closed up in position IV. While the running unit rotates the annular gear 4 continuously rolls in that way against the inside surface of the running ring 3. At the same time the tips of the teeth of the pinion and the annular gear are sealingly pressed against each other, as shown in FIGS. 1, 3 and 5.

In order to improve the starting characteristics of the internal-gear pump, compression springs may be disposed between the running ring 3 and the annular gear 4, as in the case of the internal-gear pump disclosed in DE-C-44 21 255. The compression springs are unequally prestressed even in the rest condition, as a result of the above-mentioned eccentricity between the running ring and the annular gear. In the embodiment shown in FIGS. 1 and 2 those compression springs may be arranged in the radial openings 24 in the annular gear 4 and may be supported therein on the shoulder 27 provided there (see FIG. 5).

The embodiment shown in FIGS. 11 to 14 is a so-called tube pump which is suitable and intended for high delivery pressures. Its structure and its mode of operation are the same as those of the embodiment shown in FIGS. 3 and 4 and therefore do not need to be further described here. Insofar as reference is made to identical structural members, they are identified by the reference numeral of the embodiment shown in FIGS. 3 and 4, but with the addition of the letter a.

The pinion 5'*a* is integral with the shaft 6'*a* and is supported at both sides in its own specific mounting or bearing plates or discs 8 and 9. The running unit (pinion, annular gear, running ring) is accommodated together with the bearing discs 8, 9 in a tubular casing 11'*a* which is closed at its ends by casing covers 12'*a* and 13'*a*. A radial shaft seal 7 is disposed in the casing cover 12'*a* which is at the drive side.

The bearing disc 8 at the drive side bears in sealed relationship with its periphery against the inside wall of the casing and bears with its ends against the casing cover 12'*a* and against the running unit respectively. The bearing disc 9 which is opposite the drive side is pressure-compensated both axially and also radially in order not to impede the required free mobility of the annular gear 4'*a* in the running ring 3'*a*. For that purpose, provided in the bearing disc 9 on the face which is remote from the running unit is a pressure area or portion 90 which is connected by way of a bore 91 to the pressure chamber between the annular gear 4'*a* and the pinion 5'*a*. The pressure area or portion 90 is approximately of a half-moon configuration, as can be seen from FIG. 13. By virtue of that arrangement, the bearing disc 9 is held in sealing contact against the running unit.

As can also be seen from FIG. 14, on the peripheral surface which is radially opposite the axially operative pressure area or portion, the bearing disc 9 has two radial pressure areas or portions 92 and 93 respectively which are of substantially circular shape. The bearing disc 9 is thereby prevented from tilting, which is possible by virtue of the pressure area or portion 90, and it also ensures that the running unit is sealed at its face and guarantees the required radial mobility of the annular gear 4'*a*.

Unlike the embodiment shown in FIGS. 3 and 4, the annular gear 4'*a* in the embodiment described here does not have a peripherally extending annular groove at its outer peripheral surface; the radial openings 24'*a* open directly into the outside peripheral surface.

It is possible to deviate from the embodiments described herein, without thereby departing from the invention. Thus, instead of the sealing rollers 44 which comprise plastic material, it is also possible to use rollers of ground steel, which is in any case found to be necessary when dealing with operating temperatures above for example 180° C. Furthermore, instead of a row of radial openings 24 through the annular gear 4, it is possible to provide a double row thereof in order thereby to improve the filling capacity of the gaps between the teeth. In addition, control or pre-filling slots, as shown in FIG. 10, may be provided in the casing covers in the region of the tooth arrangements of the pinion and the annular gear, instead of being arranged at the peripheral surface of the bore in the casing.

Furthermore, axial pressure plates may be provided in known manner, when dealing with high pressures, between the casing covers and the side surfaces of the running unit, in order better to control the axial forces which occur. Particularly in the embodiment shown in FIGS. 11 to 14, radial or axial pressure areas or portions may be respectively provided on both bearing discs 8, 9. Finally it will be appreciated that, as a departure from the nature of the tooth arrangement (involute tooth arrangement) in the illustrated embodiments, it is possible to adopt any other known kind of tooth arrangement, for example a trochoid or cycloid tooth arrangement.

I claim:

1. A filling member-less internal-gear pump comprising a casing (1, 1'), an internally toothed annular gear (4, 4'), which rotates in the casing, a rotatably mounted pinion (5) which meshes with the annular gear and whose teeth define a suction chamber and a pressure chamber of the tooth arrangement by engagement into gaps between the teeth of the annular gear on the one hand and sealing contact with the tips of the teeth in the annular gear in an annular gear region which is approximately diametrically opposite the engagement into the gaps between the teeth, on the other hand, and further comprising a running ring (3, 3') in which the annular gear is accommodated with a radial clearance forming an annular gap (31) and rotates therewith, wherein the peripheral surface of the annular gear has axial grooves (43) which pass through the end faces of the annular gear and in which sealing elements (44) are movably received, whereby the annular gap between the running ring and the peripheral surface of the annular gear is subdivided into peripheral portions (34) which can be sealed off relative to each other, and wherein on the side of the pressure chamber the peripheral portions of the annular gap are in flow communication with the pressure chamber by way of radial openings (24) through the annular gear, characterized in that axial grooves (32) in the inside surface (33) of the running ring (3, 3') are disposed opposite the axial grooves (43) in the peripheral surface (42) of the annular gear (4, 4'), and that the sealing elements (44) are received in the receiving spaces (45) formed by the axial grooves (32, 43) of the peripheral surface (42) of the annular gear and the inside surface (33) of the running ring, the sealing elements being movable in the peripheral direction into a position of sealing off the receiving spaces.

2. An internal-gear pump according to claim 1 characterized in that the receiving spaces (45) for the sealing elements (44) are adapted in their cross-sectional shape to the cross-sectional shape of the sealing elements and receive the sealing elements with a slight clearance.

3. An internal-gear pump according to claim 2 characterized in that the sealing elements are in the form of rollers.

4. An internal-gear pump according to claim 1 characterized in that the radial openings (24) in the annular gear open into an annular groove (25), which extends around the annular gear, in the peripheral surface of the annular gear and/or the inside surface of the running ring.

5. An internal-gear pump according to claim 1 characterized in that the axial grooves (32, 43) are arranged approximately centrally between the radial openings through the annular gear.

6. An internal-gear pump according to claim 5 characterized in that the radial openings through the annular gear each have a radially outwardly facing shoulder against which a compression spring is supported, the compression spring bearing against the inside surface of the running ring.

7. An internal-gear pump according to claim 6 characterized in that the running ring (3, 3') has openings (26, 26') which are coaxial with respect to the radial openings (24) through the annular gear (4, 4').

8. An internal-gear pump according to claim 7 characterized in that the radial openings (26') through the running ring (3') form on the suction side and on the pressure side a respective flow communication with a radially directed inlet (15') and outlet (17') respectively of the casing.

9. An internal-gear pump according to claim 1 characterized in that the pinion (5'*a*) is supported at both sides in bearing discs (8, 9) which bear sealingly against the end faces of the running unit comprising the pinion (5'*a*), the annular gear (4'*a*) and the running ring (3'*a*).

10. An internal-gear pump according to claim 9 characterized in that for the purposes of sealing the running unit at its end face at least one of the bearing discs (8, 9) has an axially operative pressure area (90) and at least one radially operative pressure area (92, 93).

* * * * *